US009009865B2

(12) United States Patent
Gilreath

(10) Patent No.: US 9,009,865 B2
(45) Date of Patent: Apr. 21, 2015

(54) CUFF WITH POSITIONABLE TAB

(71) Applicant: Amer Sports Portland Design Center, Inc., Portland, OR (US)

(72) Inventor: Abe Gilreath, Bend, OR (US)

(73) Assignee: Amer Sports Portland Design Center, Inc.

( * ) Notice: Subject to any disclaimer, the term of this patent is extended or adjusted under 35 U.S.C. 154(b) by 10 days.

(21) Appl. No.: 13/644,004

(22) Filed: Oct. 3, 2012

(65) Prior Publication Data

US 2014/0090144 A1 Apr. 3, 2014

(51) Int. Cl.
*A41B 7/00* (2006.01)
*A41B 7/06* (2006.01)

(52) U.S. Cl.
CPC ..... *A41B 7/06* (2013.01)

(58) Field of Classification Search
CPC ... A41D 19/01; A41D 2300/32; A41D 27/10; A41D 13/08
USPC ..... 2/85, 93, 269, 270, 123
See application file for complete search history.

(56) References Cited

U.S. PATENT DOCUMENTS

| | | | | | |
|---|---|---|---|---|---|
| 814,328 | A * | 3/1906 | Russell | 24/102 A |
| 1,012,648 | A * | 12/1911 | Karp | 2/270 |
| 1,118,155 | A * | 11/1914 | Scheinman | 2/228 |
| 1,361,565 | A * | 12/1920 | Christy | 2/313 |
| 1,594,905 | A * | 8/1926 | Greve | 24/42 |
| 2,162,536 | A * | 6/1939 | O'Mealia | 2/123 |
| 2,904,792 | A * | 9/1959 | Elliott | 2/16 |
| 3,111,682 | A * | 11/1963 | Swinney | 2/270 |
| 3,112,491 | A * | 12/1963 | Cleveland | 2/90 |
| 3,232,632 | A | 2/1966 | Lewis | 280/11.37 |
| 4,052,771 | A * | 10/1977 | Cole | 24/102 SL |
| 4,596,053 | A | 6/1986 | Cohen et al. | 2/1 |
| 4,676,561 | A | 6/1987 | Barrett, II | 439/37 |
| 4,847,729 | A | 7/1989 | Hee | 361/220 |
| D319,113 | S * | 8/1991 | Adams | D29/113 |
| 5,504,944 | A * | 4/1996 | Bromer et al. | 2/269 |
| 5,555,561 | A | 9/1996 | Plachta et al. | 2/2 |
| 6,212,685 | B1 * | 4/2001 | Kelly | 2/123 |
| 6,374,414 | B1 | 4/2002 | Collier | 2/69 |
| 6,405,379 | B1 * | 6/2002 | Kelly | 2/123 |
| 7,703,151 | B2 | 4/2010 | Blauer et al. | 2/270 |
| 8,850,667 | B2 * | 10/2014 | Casubolo | 24/114.8 |
| 2006/0230489 | A1 | 10/2006 | Trageser | 2/69 |
| 2012/0005862 | A1 * | 1/2012 | Severyn | 24/102 SL |

* cited by examiner

*Primary Examiner* — Khoa Huynh
*Assistant Examiner* — Anna Kinsaul
(74) *Attorney, Agent, or Firm* — Terence P. O'Brien

(57) ABSTRACT

A garment for use on the upper body of a user includes at least one sleeve portion and a tab. The sleeve portion includes a cuff having at least first, second and third spaced apart coupling locations. The tab has a proximal end region and a distal end region. The proximal end region of the tab is movably coupled to the cuff at the first coupling location. The distal end region of the tab is positionable between at least a first position wherein the distal end region is releasably coupled to the second coupling location, and a second position wherein the tab extends around the thumb of the user and releasably couples to the third coupling location.

18 Claims, 4 Drawing Sheets

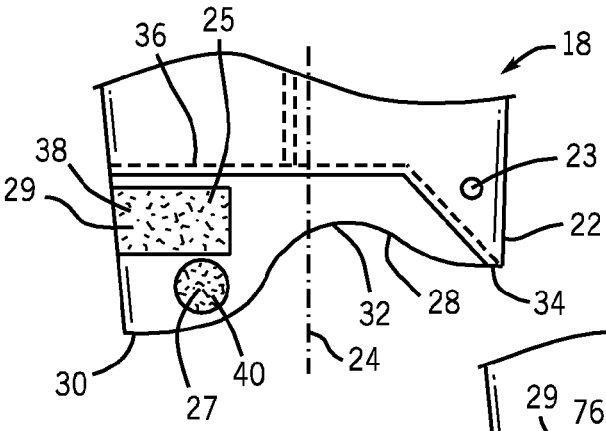
FIG. 3
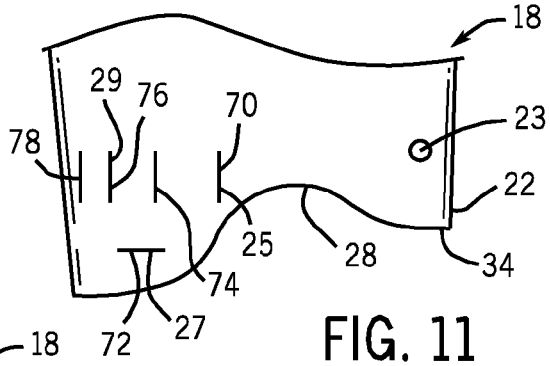
FIG. 11
FIG. 9
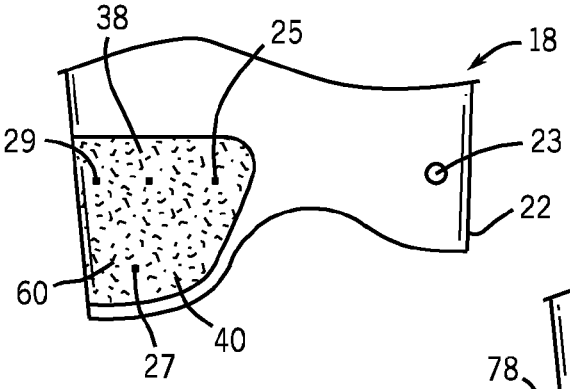
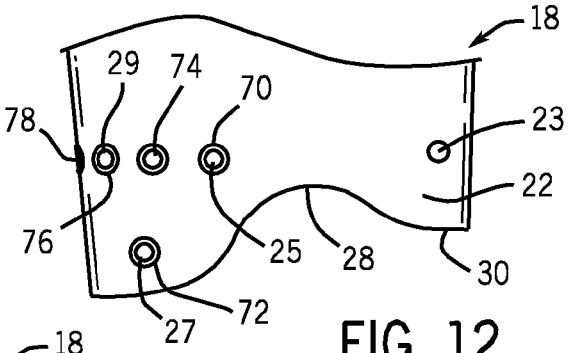
FIG. 12
FIG. 10
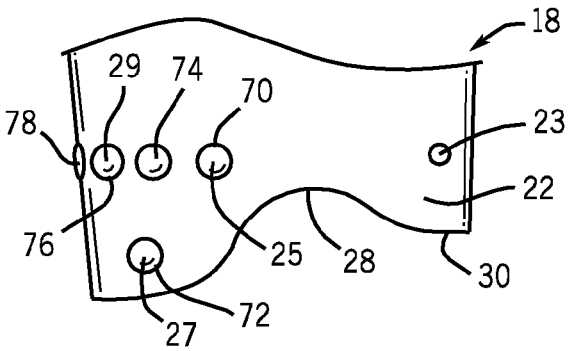

CUFF WITH POSITIONABLE TAB

FIELD OF THE INVENTION

The present invention relates to an improved cuff with a positionable tab for a sleeve portion of a garment.

BACKGROUND OF THE INVENTION

Articles of clothing or garments for an upper body of a user frequently include sleeves for covering the arms of the user. The sleeves typically terminate at a cuff that is situated at or near the wrist of the user and extends uniformly around the circumference of the sleeve. Many outer garments, such as coats, shells, jackets, hoodies, etc., have sleeves of lengths that extend past the wrist of the user to extend over at least a portion of the hand of the user. Such outer garments typically have sleeves that are sized to accommodate the user's arms, gloves, and any shirt or other upper body garments a user could be wearing. Such outer garments commonly include enlarged cuffs that can at times be disadvantageous in that they can allow for wind, snow, rain, ice and/or debris to extend up the sleeve of the garment during use, and the sleeve itself can often be moved upward, or run-up the user's arm, through movement of the user's arms or through contact with other surfaces.

Many garments include adjustment mechanisms for adjusting the size of the opening of the sleeve at the cuff and at other locations on a garment. However, many existing adjustment mechanisms have drawbacks. Many existing sleeve or cuff adjustment mechanisms can be bulky, stiff and/or difficult to manipulate, particularly with gloved hands. Many existing sleeve or cuff mechanisms add undesirable weight to the outer garment decreasing the user's ability to move freely while wearing the garment. Other sleeve adjustment mechanisms can be abrasive and can cause discomfort to the user when tightened against a user's arm. Still other adjustment mechanisms have two basic positions, loose and tightened that are essentially two sizes fit all. Such adjustment mechanisms do not meet the needs of all users and can result in a tightened position that is either too tight or too loose.

Accordingly, a need exists for an improved adjustment mechanism for the sleeves of an upper body garment, such as an outer garment. What is needed is an adjustment mechanism that is lightweight, flexible, and easy to use, even by gloved users. It would be desirable to provide an improved sleeve adjustment mechanism that does not inhibit a user's ability to move or manipulate his or her wrist, hand and/or thumb even when snugly tightened. It would also be desirable to have an improved sleeve adjustment mechanism that can help prevent the sleeves of the garment from running up the user's arms during use. What is also needed is a sleeve adjustment mechanism that is not abrasive and that does not cause discomfort to the user when tightened. Thus, a need exists for a sleeve adjustment mechanism that can provide multiple operating positions and accommodate the needs of all users, while also providing a pleasing aesthetic.

SUMMARY OF THE INVENTION

The present invention presents a garment for use on the upper body of a user includes at least one sleeve portion and a tab. The sleeve portion includes a cuff having at least first, second and third spaced apart coupling locations. The tab has a proximal end region and a distal end region. The proximal end region of the tab is movably coupled to the cuff at the first coupling location. The distal end region of the tab is positionable between at least a first position wherein the distal end region is releasably coupled to the second coupling location, and a second position wherein the tab extends around the thumb of the user and releasably couples to the second or third coupling locations.

According to a principal aspect of a preferred form of the invention, a garment for use on the upper body of a user includes at least one sleeve portion and a flexible tab. The sleeve portion has a longitudinal dimension and includes a cuff having first and second coupling locations and a cuff edge. The length of the cuff with respect to the longitudinal dimension varies around the circumference of the sleeve portion such that the cuff defines a thumb region and a non-thumb region. The average length of the cuff at the thumb region is shorter or smaller than the average length of the non-thumb region. The tab has a proximal end region and a distal end region. The proximal end region of the tab is movably coupled to the cuff at the first coupling location. The distal end region of the tab is releasably coupled to the cuff at the second coupling location.

This invention will become more fully understood from the following detailed description, taken in conjunction with the accompanying drawings described herein below, and wherein like reference numerals refer to like parts.

BRIEF DESCRIPTION OF THE DRAWINGS

FIG. 3 is a top view of the cuff of FIG. 2 without the tab or a first tab fastener.

FIGS. 9 through 12 are top views of a cuff of a sleeve portion of a garment in accordance with alternative preferred embodiments of the present invention.

DETAILED DESCRIPTION OF THE INVENTION

Figure 1:
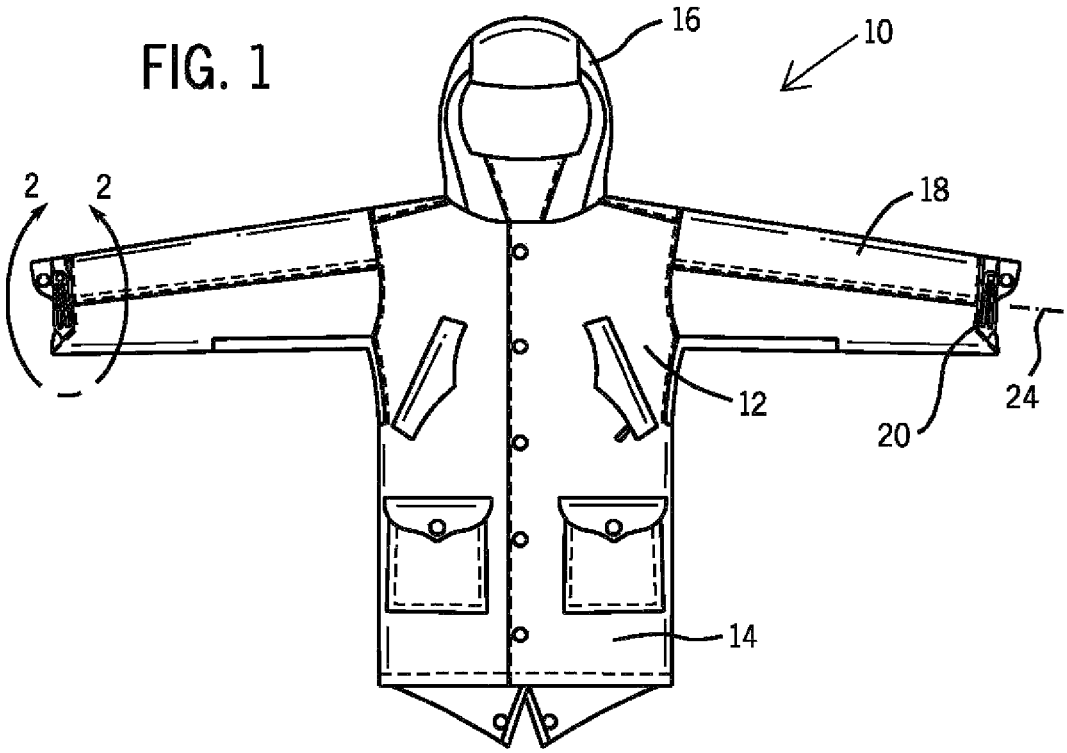
FIG. 1 is a front view of a garment in accordance with a preferred embodiment of the present invention.

Referring to FIG. 1, a garment for use on an upper body of a user is generally indicated as item 10. The garment 10 of FIG. 1 is configured as a jacket; however, the invention can also directly applicable and can applied to an inner lining, an inner shell, an outer shell, an intermediate shell, a coat, a hoodie, a sweater, a shirt, or other form of upper body garment. The garment 10 includes a torso 12, a waist 14, a hood 16, a pair of sleeves 18 and a sleeve adjustment mechanism 20. The garment 10 can be an outer garment configured for use in all types of weather, for all forms of outdoor activity, and for wear individually or with one or more other upper body garments. The garment 10 can be constructed of a variety of materials to provide one or more of the following characteristics wind-resistance, moisture resistance, insulation, durability, wear-resistance, debris-resistance, flexibility, breathability, resiliency, comfort and style. Examples of materials that can be used for the garment include woven and unwoven fabrics, clothes, knits or textiles, nylon, cotton, other synthetic or natural materials, elastic materials, inelastic materials, rubber, wool, cotton, leather, synthetic leather, polyester, other polymeric materials and combinations thereof.

As illustrated in FIGS. 2 through 5, the sleeve 18 and the sleeve adjustment mechanism 20 are shown in more detail. The sleeve 18 is an elongate tubular body that includes a cuff 22 positioned at or near the end of the sleeve 18. For the purposes of this application, the term "cuff" shall refer to the bottom or end region of the sleeve of a garment. The cuff may be a single layer of material or multiple layers of material. The cuff may include may include a fold or band that serves as a trimming or finish the bottom of the sleeve. The cuff may also include a turned-up fold at the bottom of the sleeve. The cuff may also include a band positioned at or near the bottom of the sleeve.

Each of the sleeves 18 when in an extended position defines a longitudinal axis, such as axis 24. The cuff 22 preferably includes a cuff edge 26 at the end of the sleeve 18. The cuff 22 has a length, measured with reference to the longitudinal axis 24, that preferably varies about the circumference of the sleeve 18. In one preferred embodiment, the length of the cuff 22 varies about the circumference of the sleeve 18 such that the cuff 22 defines a thumb region 28 and a non-thumb region 30. The thumb region 28 having a curved edge 32 that is configured to extend around the thumb, or allow for uninhibited movement of the thumb, of a user when the garment 10 is worn. The non-thumb region 30 preferably extends away from the thumb region 28 and has an edge 34 that slopes away from the thumb region 28. The edge 34 of the non-thumb region 30 can be sloped or slanted or curved. The average lengths of the thumb region 28 and the non-thumb region 30 measured with respect to the longitudinal axis 24 are preferably not the equal to each other. The average length of the thumb region 28 is preferably less (shorter or smaller) than the average length of the non-thumb region 30. The curved edge 32 of the thumb region 28 advantageously sized and curved to accommodate the user's thumb during use. In one preferred embodiment, at least a portion of the curved edge 32 of the thumb region 28 has a radius of curvature within the range of 0.25 to 1.0 inches. In other embodiments, alternative radii of curvature can be used. The unique cuff edge 26 enhances the comfort and utility of the garment by allowing the cuff to extend over and a larger portion of the user's wrist and hand while leaving the thumb of the user uncovered. The cuff edge 26 allows the user to freely use his or her thumb for a variety of activities without experiencing interference, binding or obstruction by the cuff edge 26. In alternative preferred embodiments, the edge of the thumb region and/or the edge of the non-thumb region can be sloped, slanted, straight, squared or irregularly shaped.

The cuff 22 may include one or more seams for securing the fold of material forming at least a portion of the cuff. In one preferred embodiment, the seam 36 extends around substantially the entire circumference of the cuff 22. The seam 36 is preferably a stitching that is reinforced on its inner surface by a seam tape (not shown). In other alternative embodiments, the seam can be placed in other locations and extend about the sleeve in a different direction. In other alternative embodiments, the seam can be formed of two or more stitching or without stitching. In other alternative embodiments, the seam may be formed without a seam tape.

Figure 2:
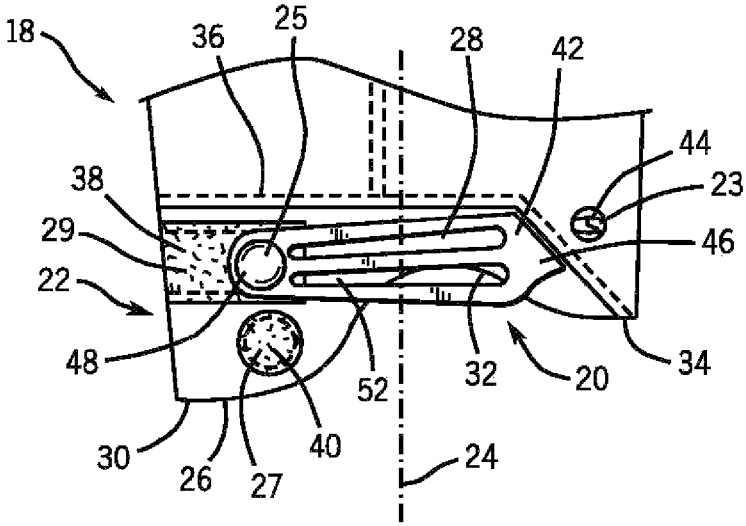
FIG. 2 is an enlarged front view of a sleeve adjustment mechanism for a cuff of a sleeve portion of the garment of FIG. 1.

Referring to FIGS. 2 and 3, the cuff 22 preferably includes at least first, second, third and fourth spaced apart coupling locations 23, 25, 27 and 29 and third and fourth releasable fastening elements 38 and 40. The third and fourth fastening elements 38 and 40 can be spaced apart from each other and secured to the outer surface of the cuff 22 at the second and third coupling locations 25 and 27. The third and fourth fastening elements 38 and 40 are preferably stitched and laminated to the cuff 22, but can also be secured to the cuff through use of one or more adhesives or through other conventional securing means. In alternative preferred embodiments, the at least first, second, third and fourth spaced apart coupling locations can include only two, only three, five, six, seven or more spaced apart coupling locations.

The third and fourth fastening elements 38 and 40 are preferably one of a hook or loop type fastening element, such as Velcro® hook-and-loop fasteners produced by Velcro USA Inc. of Manchester, N.H. The first and second fastening elements 38 and 40 are configured for releasably coupling to corresponding or mating fastening elements. As used herein, the terms "coupled" or "coupling" shall mean the direct or indirect (through one or more intermediate coupling members) connection, attachment or engagement of one element to another element. As used herein, the terms "releasably coupling" or "releasably coupled" refers to elements that can be fastened, attached and/or engaged to each other and then unattached or disengaged repeatedly as desired by the user numerous times over the usable life of the garment without damaging the fastening components or the substrates to which the fastening components are affixed. The shape and size of the first and second fastening elements 38 and 40 can be varied to meet the particular size of the garment, application of the garment, desired style or other design considerations. In one particularly preferred embodiment, the third and fourth fastening elements 38 and 40 are loop fastening elements.

Figure 4:
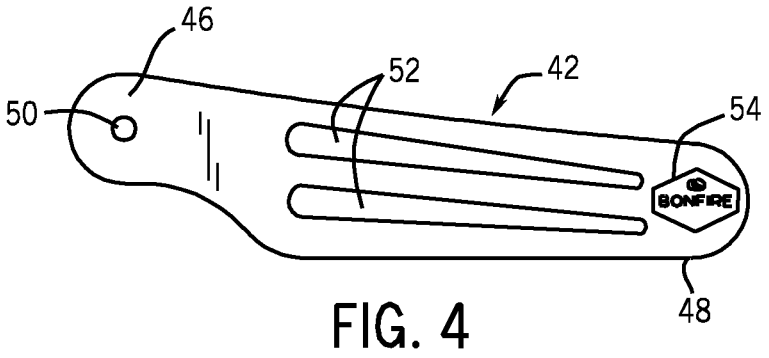
FIG. 4 is a top view of a tab in accordance with a preferred embodiment of the present invention.
Figure 5:
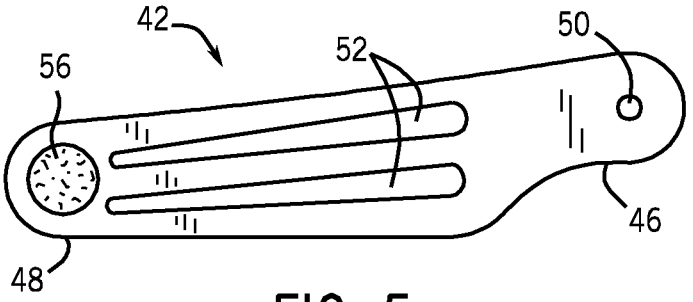
FIG. 5 is a bottom, underside view of the tab of FIG. 4.

Referring to FIGS. 2, 4 and 5, the sleeve adjustment mechanism 20 includes a tab 42 coupled to the cuff 22. In one preferred embodiment, the tab 42 is coupled to the cuff 22 by a first fastener 44 at the first coupling location 23 of the cuff 22. The tab 42 is a strap having a proximal end region 46 and a distal end region 48. The proximal end region 46 can include an aperture 50 for receiving the first fastener 44. The tab 42 is preferably formed of a flexible, durable material, such as, for example, a woven fabric. Alternatively, the tab can be formed of other materials such as unwoven fabrics, a thermoplastic material, a thermoset material, a rubber, a polymeric material, a laminated material, and combinations thereof. The tab 42 is preferably formed of a material with limited elasticity. In other alternative embodiments, the tab can be formed of one or more highly elastic or inelastic materials.

In a particularly preferred embodiment, the proximal end region 46 of the tab 42 is movably or pivotally coupled to the cuff 22 and the first fastener 44 is a rivet. In other alternative preferred embodiments, the first fastener can be other types of fasteners such as, for example, a stitching, an adhesive, a clamp, a buckle, snap, or other conventional fastener. When movably coupled, the tab 42 is free to move with respect to the cuff 22 about one or more axes of rotation. When pivotally coupled, the tab 42 is configured to rotate about a single axis of rotation defined by the first fastener 44. In one particularly preferred embodiment, the tab is configured to rotate 360 degrees about the first fastener 44. In another alternative embodiment, the tab is configured to rotate about the first fastener within the range of 45 to 270 degrees. In other alternative embodiments, other angular ranges of rotation can also be used.

The tab 42 preferably has a length within the range of 80 to 160 mm. In alternative embodiments, other lengths can also be used. The tab 42 is preferably formed with one or more openings 52. The openings 52 are shaped and configured to increase and optimize the flexibility and ease of use of the tab 42. In one particularly preferred embodiment, the at least one opening 52 are two generally parallel slots extending over a majority of the length of the tab 42. In other alternative embodiments, other numbers of openings, and other shapes and sizes of openings, can be used. Referring to FIG. 4, the outer surface of the tab 42 can include graphical and/or alphanumeric indicia 54 indicative of designs, trademarks, graphics, specifications, certifications, instructions, warnings and/or markings.

Figure 13:
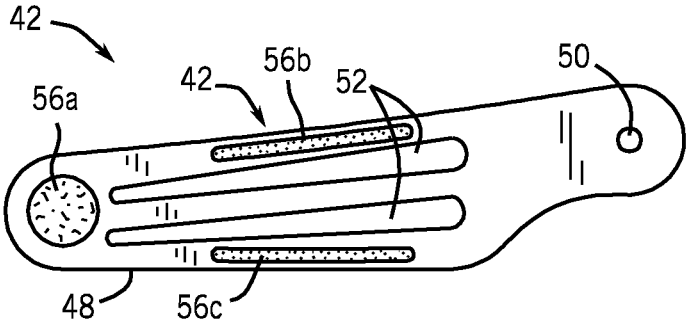
FIG. 13 is a bottom, underside view of the tab of FIG. 4 in accordance with an alternative preferred embodiment of the present invention.

Referring to FIG. 5, the distal end region 48 of the tab 42 preferably includes a second releasable fastening element 56. The second fastening elements 56 is preferably one of a hook or loop type fastening element, configured for releasably coupling to corresponding or mating fastening elements, such as one of the third and fourth fastening elements 38 and 40. In one particularly preferred embodiment, the second releasable fastening element 56 is a hook fastening elements. The second releasable fastening element 56 can be sized to extend along only the distal end region 48 of the inner surface of the tab 42, or it can extend to any portion of the inner surface of the tab 42. In other preferred embodiments, the second releasable fastening element can be an alternative fastening element, such as, for example, a loop fastening element, a button, a snap, a buckle, a screw, a nut, a tie, a tongue and groove connector, or other conventional fastener. Referring to FIG. 13, in other preferred embodiments, the second releasable fastening element 56 can be two or more spaced apart elements 56*a*, 56*b* and 56*c* positioned about the inner surface of the tab. Although FIG. 13 illustrates one particularly preferred embodiments, the second releasable fastening element 56 or elements 56 *a, b* and *c* can take other shapes, be positioned in other locations about the tab and/or have other quantities.

Figure 6:
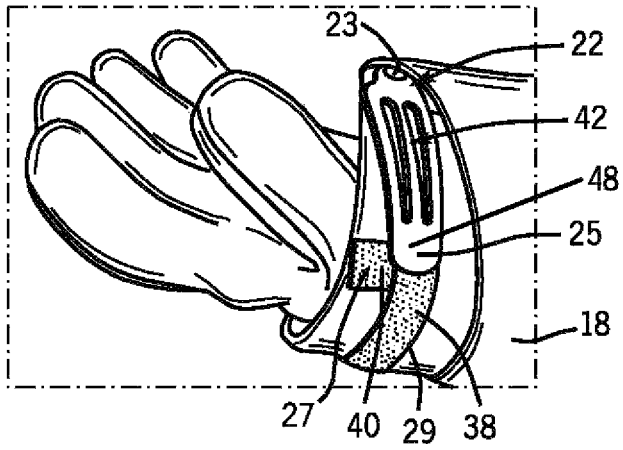
FIG. 6 is a side perspective view of the sleeve adjustment mechanism of FIG. 2 in a first position.
Figure 7:
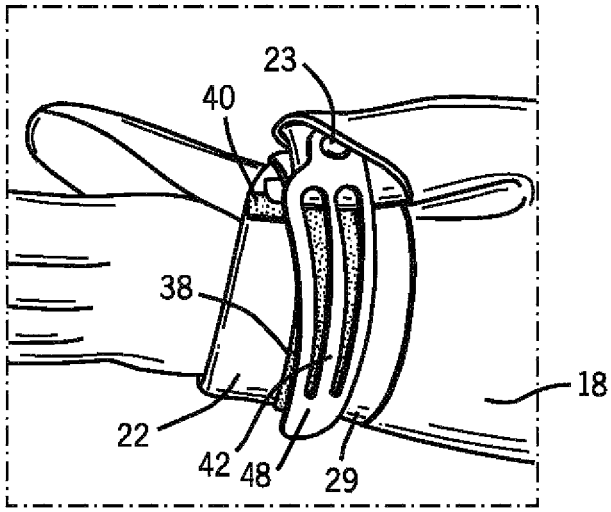
FIG. 7 is a side perspective view of the sleeve adjustment mechanism of FIG. 2 in a second position.
Figure 8:
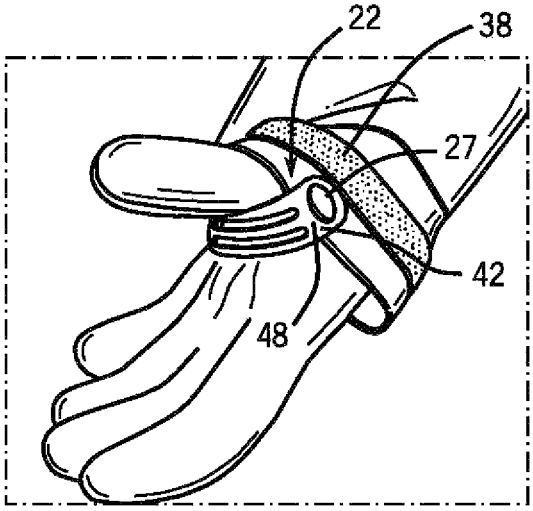
FIG. 8 is a side perspective view of the sleeve adjustment mechanism of FIG. 2 in a third position.

Referring to FIGS. 6 through 8, the sleeve adjustment mechanism 20 and the cuff 22 are configured to accommodate numerous fastening positions. The distal end region 48 of the tab 42 is positionable between at least a first position wherein the distal end region 48 is releasably coupled to the third fastening element 38 of the cuff 22 at the second coupling location 25 (FIG. 6), and a second position wherein the tab 42 extends around the thumb of the user and releasably couples to the third coupling location 27 of the cuff 22 (FIG. 8). The distal end 48 of the tab 42 can also be positionable to a third position wherein the distal end region 48 is releasably coupled to the third fastening element at fourth coupling location 29 (FIG. 7). In alternative preferred embodiments, additional coupling locations on the cuff can be employed to define additional releasable coupling positions of the tab 42 to the cuff 22.

The flexibility and configuration of the tab 42, and the configuration of the cuff 22 enables the user to readily reposition the tab 42 to select one of a plurality of desired fastening positions. The first position of FIG. 6 enables the user to secure the tab 42 to the cuff 22 while maintaining the sleeve 18 and the cuff 22 in an open position. The tab 42 extends directly from the first coupling location 23 to the second coupling location 25 without extending around the thumb of the user. Such a position can be used to facilitate the user's ability to put on and remove the garment, even if the user's hands are gloved. The open position of FIG. 6 allows the user to freely rotate his or her wrist (or gloved hand) without binding to the sleeve 18 of the garment 10. The open position can also allow for additional airflow into the garment 10.

In the position of FIG. 7, the tab 42 is secured to the fourth coupling location 29 of the cuff 22 without extending around the thumb of the user. In this position, the user can readily adjust the cuff to secure the cuff to the wrist or gloved hand of the user. The secured position inhibits the introduction of rain, snow, debris, or air from entering the garment through the sleeve. The fourth coupling location 29 is shown as a single point, but it can be a region. It is the coupling location where the cuff is securely fitted or wrapped around the wrist of the users or the wrist of the gloved user. It can be slightly different from one user to another based upon factors such as wrist size, glove size, sleeve material, etc.

In the position of FIG. 8, the tab 42 extends from the first coupling location 23 over the thumb of the user and the distal end region 48 of the tab 42 releasably couples to the fourth fastening element 40 at the third coupling location 27. In this position, the tab 42 secures the sleeve to the hand or gloved hand of the user and serves to maintain the sleeve 18 in the desired extended position. The position of FIG. 8 inhibits the sleeve from running up the arm of the user when contacting the ground or other surfaces during use, or from flexing or moving of the sleeve of the garment 10 over time. In another preferred embodiment, the tab 42 can be configured to enable the distal end region 48 of the tab 42 to releasably couple to the second or the third coupling location 25 or 27. In other preferred embodiments, the tab 42 can be configured to extend around the thumb of the user and releasably couple to any location of the cuff.

The cuff 22 and sleeve adjustment mechanism 20 of the present invention provides the user with enhanced flexibility and easy efficient adjustment of the sleeve of the garment to the user. It enables the user to optimize the position of the sleeve to match the size of the user, and the desired activity in which the user is engaged. The cuff and sleeve adjust mechanism is lightweight, durable and easily manipulated by the user. The cuff 22 and sleeve adjustment mechanism 20 does not inhibit a user's ability to move or manipulate his or her wrist, hand and/or thumb even when snugly tightened. The sleeve adjustment mechanism provides multiple operating positions and accommodates the needs of all users, while also providing a pleasing aesthetic.

Referring to FIG. 9, in an alternative preferred embodiment the third and fourth fastening elements 38 and 40 can be included on a single fastening element 60, such as a single loop fastener or a single hook fastener. The single fastening element 60 is attached to the cuff 22 in a manner similar to the third and fourth fastening elements 38 and 40, and can include the second, third and fourth spaced apart coupling locations 25, 27 and 29, and can also include additional coupling locations as desired by the user. The single fastening element 60 can provide additional design flexibility. In other alternative preferred embodiments, the single fastening element can take be formed of a different shape and a different size. For example the single fastening element can be shaped and sized to extend about the entire cuff or a portion thereof.

Referring to FIGS. 10 through 12, in alternative preferred embodiments of the present invention, the fastening elements 70, 72, 74, 76 and 78 can be formed of other types of fasteners other than a hook and/or loop fastener. The fastening elements 70, 72, 74, 76 and 78 can be buttons (FIG. 10), button receiving slots (FIG. 11), or snaps (FIG. 12) for receiving corresponding mating fastening elements attached to the distal end region of the tab. In other alternative preferred embodiments, other quantities of fastening elements (fewer or additional) can be used in different spaced apart locations. In still other alternative preferred embodiments, other types of conventional fasteners can be used as the fastening elements.

While the preferred embodiments of the invention have been illustrated and described, it will be appreciated that various changes can be made therein without departing from the spirit and scope of the invention. For example, the present invention could be applied to a pant leg or a head opening of a garment. Accordingly, it will be intended to include all such alternatives, modifications and variations set forth within the spirit and scope of the appended claims.

What is claimed is:

1. A garment for use on the upper body of a user, the garment comprising:

at least one sleeve portion and including a cuff, the cuff having at least first, second and third spaced apart coupling locations, the at least one sleeve portion having a longitudinal dimension and defining a longitudinal axis when the sleeve portion is in an extended position, the cuff terminating at a cuff edge, the cuff having a length that varies with respect to the longitudinal dimension around the circumference of the sleeve portion, the cuff defining a thumb region and a non-thumb region, the shortest length of the thumb region being less than the shortest length of the non-thumb region; and a tab having a proximal end region and a distal end region, the proximal end region of the tab pivotally coupled about a pivot axis to the cuff at the first coupling location by a rivet first tab fastener, the pivot axis extending radially from the longitudinal axis and being perpendicular to the proximal end region of the tab, the distal end region of the tab including a second tab fastener, the second tab fastener being a releasable fastener, the tab being positionable between at least a first position wherein the distal end region is releasably coupled to the second coupling location, and a second position wherein the tab extends around a thumb of the user and releasably couples to one of the second and the third coupling locations, the entire tab configured to rotate about the pivot axis by at least 10 degrees between the at least first and second positions, the second and third coupling locations including at least third and fourth fasteners, each of the third and fourth fasteners being configured for releasable engagement with the second tab fastener.

2. The garment of claim 1, wherein the rivet first tab fastener includes a rivet head, and wherein the rivet head is exposed so as to be visible to the user.

3. The garment of claim 1, wherein the tab is formed of a durable flexible material selected from the group consisting of a thermoplastic material, a thermoset material, a woven fabric, a non-woven fabric, a rubber, a polymeric material, a laminated material, and combinations thereof.

4. The garment of claim 1, wherein the tab defines at least one opening.

5. The garment of claim 1, wherein the tab has a length within the range of 80 mm to 160 mm.

6. The garment of claim 1, wherein the second tab fastener is a selected from the group consisting of a hook fastening element, a loop fastening element, a male snap element, a female snap element, a male buckle element, a female buckle element, a button, a button hole, and combinations thereof.

7. The garment of claim 1, wherein the third and fourth fasteners are selected from the group consisting of a hook fastening element, a loop fastening element, a male snap element, a female snap element, a male buckle element, a female buckle element, a button, a button hole, and combinations thereof.

8. The garment of claim 1 wherein the third and fourth fasteners are separate regions of a hook or loop fastening element, and the second tab fastener is the other hook or loop fastening element.

9. The garment of claim 1, wherein the first, second and third coupling locations of the cuff are at least first, second, third and fourth coupling locations, wherein the at least first and second positions are at least first, second and third positions, wherein the at least first and second positions are at least first, second and third positions, and wherein, in the third position, the distal end region of the tab is releasably coupled to the fourth coupling location.

10. The garment of claim 1, wherein the tab extends over the cuff from the first coupling location to the second coupling location without extending over the thumb of the user.

11. The garment of claim 9, wherein the tab extends over the cuff from the first coupling location to the fourth coupling location without extending over the thumb of the user.

12. A garment for use on an upper body of a user, the garment comprising:

at least one sleeve portion having a longitudinal dimension and including a cuff, the cuff including at least first, second, third and fourth spaced apart coupling locations and a cuff edge, the at least one sleeve portion defining a longitudinal axis when the sleeve portion is in an extended position, the cuff having a length that varies with respect to the longitudinal dimension around the circumference of the sleeve portion such that the cuff defines a thumb region and a non-thumb region, wherein the shortest length of the thumb region is less than the shortest length of the non-thumb region, measured with respect to the longitudinal axis, the second and fourth coupling locations positioned at a first coupling sleeve length measured with respect to the longitudinal axis, the third coupling location positioned at a second coupling sleeve length measured with respect to the longitudinal axis, the second coupling sleeve length being greater than the third sleeve length; and a flexible tab having a proximal end region and a distal end region, the proximal end region of the tab pivotally coupled to the cuff at the first coupling location about a pivot axis, the pivot axis extending radially from the longitudinal axis and being perpendicular to the proximal end region of the tab, the distal end region of the tab including a first releasable fastener element, the tab being rotatably positionable by at least 10 degrees between at least a first position wherein the distal end region is releasably coupled to the second coupling location, and a second position wherein the tab extends around a thumb of the user and releasably couples to the third coupling location.

13. The garment of claim 12, wherein the thumb region of the cuff edge curves so as to accommodate and extend over the thumb of the user.

14. The garment of claim 12 wherein at least a portion of the cuff edge at the thumb region has a radius of curvature within the range of 0.25 to 1.0 inches.

15. The garment of claim 12, wherein the proximal end region of the tab is pivotally coupled to the cuff by a rivet.

16. The garment of claim 12, wherein the tab is formed of a durable flexible material selected from the group consisting of a thermoplastic material, a thermoset material, a woven fabric, a non-woven fabric, a rubber, a polymeric material, a laminated material, and combinations thereof.

17. The garment of claim 12, wherein the tab defines at least one opening.

18. The garment of claim 12, wherein the tab has a length within the range of 80 mm to 160 mm.

* * * * *